US011664005B2

(12) United States Patent
Yang et al.

(10) Patent No.: US 11,664,005 B2
(45) Date of Patent: May 30, 2023

(54) METHOD FOR CONTROLLING INTERIOR SOUND IN A VEHICLE AND A DEVICE FOR CONTROLLING SOUND PROVIDING THE METHOD

(71) Applicants: HYUNDAI MOTOR COMPANY, Seoul (KR); KIA CORPORATION, Seoul (KR)

(72) Inventors: Jaesik Yang, Seoul (KR); Seonghyeon Kim, Seoul (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/739,436

(22) Filed: May 9, 2022

(65) Prior Publication Data

US 2023/0118606 A1 Apr. 20, 2023

(30) Foreign Application Priority Data

Oct. 15, 2021 (KR) ..... 10-2021-0137337

(51) Int. Cl.
*G10K 11/178* (2006.01)
*G10K 11/00* (2006.01)

(52) U.S. Cl.
CPC ..... *G10K 11/17873* (2018.01); *G10K 11/002* (2013.01); *G10K 2210/1282* (2013.01)

(58) Field of Classification Search
None
See application file for complete search history.

(56) References Cited

U.S. PATENT DOCUMENTS

2005/0213776 A1* 9/2005 Honji ..... H03G 3/32 381/103
2020/0193960 A1* 6/2020 Jung ..... G10L 25/51

FOREIGN PATENT DOCUMENTS

KR 20150059379 A 6/2015
KR 20190063850 A 6/2019

* cited by examiner

*Primary Examiner* — Kenny H Truong
(74) *Attorney, Agent, or Firm* — Lempia Summerfield Katz LLC

(57) ABSTRACT

A sound control device controls an interior sound in a vehicle based on a slope of a road on which the vehicle travels. The sound control device includes: a sound canceling circuit for generating a first correcting sound for lowering a level of an interior sound measured in the vehicle; a sound boosting circuit for generating a second correcting sound for increasing the level of the interior sound; and a controller for setting a level of a second target sound to be less than a level of a first target sound. In particular, the second target corresponds to a ramp in which an absolute value of the slope is greater than a reference value and the first target sound corresponds to a flatland in which the absolute value of the slope is equal to or less than the reference value.

15 Claims, 10 Drawing Sheets

METHOD FOR CONTROLLING INTERIOR SOUND IN A VEHICLE AND A DEVICE FOR CONTROLLING SOUND PROVIDING THE METHOD

CROSS-REFERENCE TO RELATED APPLICATION

This application claims priority to and the benefit of Korean Patent Application No. 10-2021-0137337, filed in the Korean Intellectual Property Office on Oct. 15, 2021, the entire contents of which are incorporated herein by reference.

BACKGROUND

(a) Field

The present disclosure relates to a method for controlling interior sound in a vehicle for increasing satisfaction of a driver by controlling noise generated when the vehicle runs, and a vehicle system providing the method.

(b) Description of the Related Art

Sound in a vehicle has a greater meaning than a simple sound. Vehicle interior sounds, such as the engine sound or the sound for notifying a driver of an on/off status of doors of the vehicle, add an emotional function to the functional role and thereby substantially provide a good impression of the entire vehicle. Recently, vehicle makers concentrate on improving interior sound of the vehicles.

When the interior sound of the vehicle is designed, basic skills used thereto include active noise cancellation (ANC) and active sound design (ASD). For example, the ANC method senses driving of an engine, generates an opposite-phase sound of engine noise, and applies noise canceling to reduce the engine noise in the vehicle. The ASD method synthesizes a virtual engine sound by generating an additional sound linking to the operation of the engine. The vehicle manufacturers appropriately combine the ANC method for reducing unnecessary noise and the ASD method for generating rich and dynamic engine sound by adding new sound to the existing sound to design the interior sound of the vehicle.

When the vehicle runs on a flatland and a ramp, the vehicle system is controlled in different ways. For example, compared to the case of running on the flatland, the vehicle may not easily accelerate on an uphill road because of gradient running resistance. Therefore, the driver further accelerates the vehicle. To obtain a driving torque on the uphill road, the vehicle system maintains a low gear long by delaying a position converting time of a transmission, and as a result, engine revolutions per minute (RPM) increase. For another example, compared to the case of running on the flatland, gradient running resistance functions opposite to a vehicle running direction on the downhill road, so the vehicle speed increases. Hence, the driver tries to press his foot on a brake pedal to maintain the speed. To obtain deceleration and reduce a load of the brake on the downhill road, the vehicle system quickly converts into the low gear to increase an interval of using the low gear, and the engine RPM resultantly increases.

That is, compared to the case of running on the flatland, when the vehicle speed is the same and the vehicle is running on the ramp, the engine RPM further increases, and a noise level may become higher because of the high engine RPM.

However, in prior art, without considering states of the road (e.g. ramp, flatland, etc.) on which the vehicle travels, the interior sound of the vehicle is designed to be generated according to a same target sound when the vehicle speed is the same. Accordingly, the sound the driver hears in the vehicle is recognized as noise.

The above information disclosed in this Background section is only for enhancement of understanding of the background of the present disclosure, and therefore it may contain information that does not form the prior art that is already known to a person of ordinary skill in the art.

SUMMARY

The present disclosure provides a method for controlling interior sound in a vehicle for increasing satisfaction of a driver by controlling noise generated when the vehicle runs on a ramp, and a device for controlling sound using the method.

An embodiment of the present disclosure provides a device for controlling an interior sound in a vehicle, that is a sound control device for controlling an interior sound in a vehicle corresponding to a slope of a road on which the vehicle travels. The device includes: a sound canceling circuit for generating a first correcting sound for lowering a level of an interior sound measured in the vehicle; a sound boosting circuit for generating a second correcting sound for increasing the level of the interior sound; and a controller for setting a level of a second target sound corresponding to a ramp in which an absolute value of the slope is greater than a reference value. The level of the second target sound is less than a level of a first target sound corresponding to a flatland in which the absolute value of the slope is equal to or less than the reference value. When the vehicle travels on the ramp, the controller controls the sound canceling circuit and the sound boosting circuit so that the level of the interior sound follows the level of the second target sound.

In another embodiment of the present disclosure, a method for controlling an interior sound of a vehicle based on a slope of a road on which the vehicle travels includes: determining whether the road is a flatland in which an absolute value of the slope is equal to or less than a reference value or a ramp in which the absolute value of the slope is greater than the reference value; determining a level of the second target sound so that a level of a second target sound corresponding to the ramp is lower than a level of a first target sound corresponding to the flatland when the road is the ramp according to a result of the determination; and generating a first correcting sound for lowering the level of the interior sound or a second correcting sound for increasing the level of the interior sound so that the level of the interior sound follows the level of the second target sound.

The present disclosure classifies the road on which the vehicle travels into the flatland or the ramp (uphill/downhill roads), and controls the interior sound of the vehicle to fit the road condition, thereby increasing the driver's satisfaction.

BRIEF DESCRIPTION OF THE DRAWINGS

In order that the disclosure may be well understood, there will now be described various forms thereof, given by way of example, reference being made to the accompanying drawings, in which.

Figure 1:
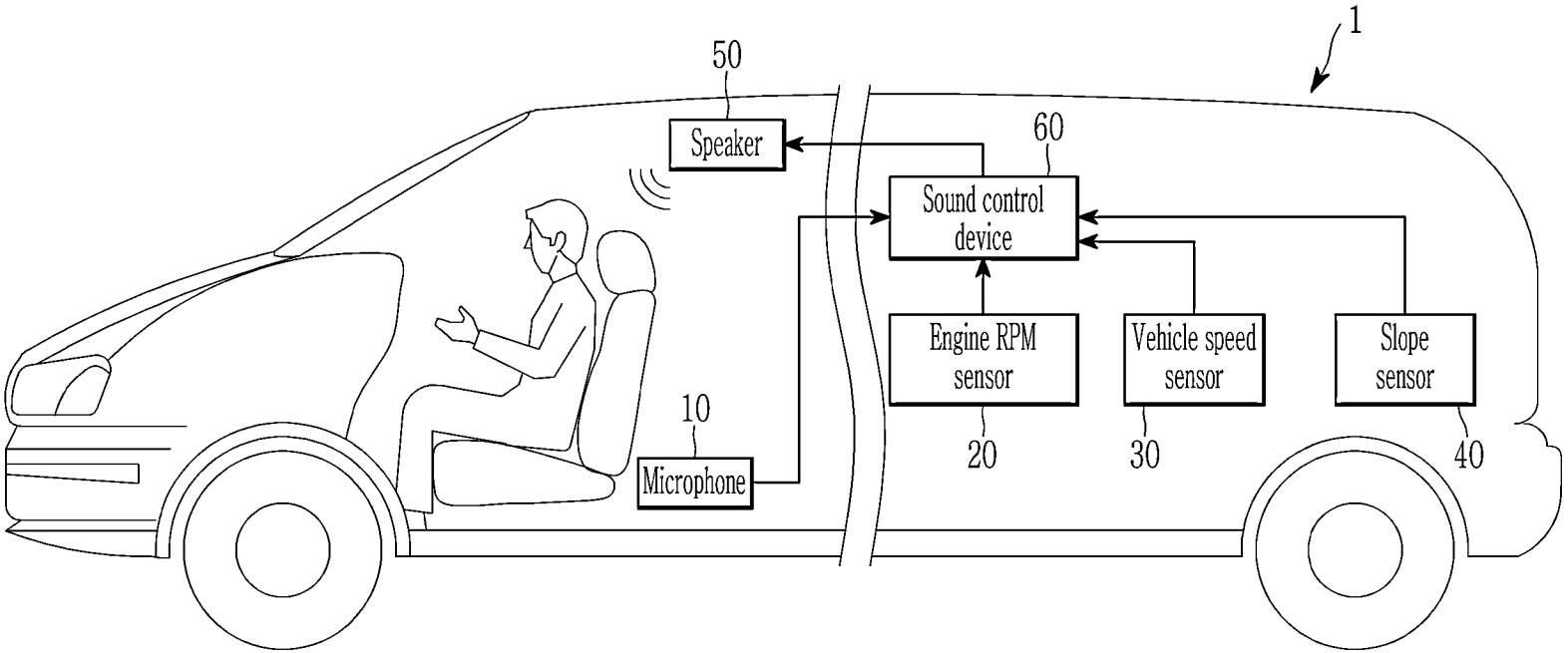
FIG. 1 shows a vehicle system for controlling an interior sound of a vehicle according to an embodiment.

The drawings described herein are for illustration purposes only and are not intended to limit the scope of the present disclosure in any way.

DETAILED DESCRIPTION

Hereinafter, embodiments disclosed in the present specification are described in detail with reference to the accompanying drawings. In the present disclosure, the same or similar components are denoted by the same or similar reference numerals, and an overlapped description thereof is omitted. The terms "module" and "unit" for components used in the following description are used only in order to make the specification easier. Therefore, these terms do not have meanings or roles that distinguish them from each other by themselves. In describing embodiments of the present disclosure, a detailed description of the well-known art associated with the present disclosure is omitted when the description obscures the gist of the present disclosure. The accompanying drawings are provided only in order to allow embodiments disclosed in the present disclosure to be easily understood and are not to be interpreted as limiting the spirit disclosed in the present specification, and it is to be understood that the present disclosure includes all modifications, equivalents, and substitutions without departing from the scope and spirit of the present disclosure.

Terms including ordinal numbers such as first, second, and the like, are used only to describe various components, and are not interpreted as limiting these components. The terms are only used to differentiate one component from others.

It is to be understood that when one component is referred to as being "connected" or "coupled" to another component, it may be connected or coupled directly to another component or be connected or coupled to another component with the other component intervening therebetween. On the other hand, it is to be understood that when one component is referred to as being "connected or coupled directly" to another component, it may be connected or coupled to another component without the other component intervening therebetween.

It should be further understood that terms "comprise" or "have" used in the present disclosure specify the presence of stated features, numerals, steps, operations, components, parts, or a combination thereof, but do not preclude the presence or addition of one or more other features, numerals, steps, operations, components, parts, or a combination thereof.

When a component, device, element, or the like of the present disclosure is described as having a purpose or performing an operation, function, or the like, the component, device, or element should be considered herein as being "configured to" meet that purpose or to perform that operation or function.

Figure 2:
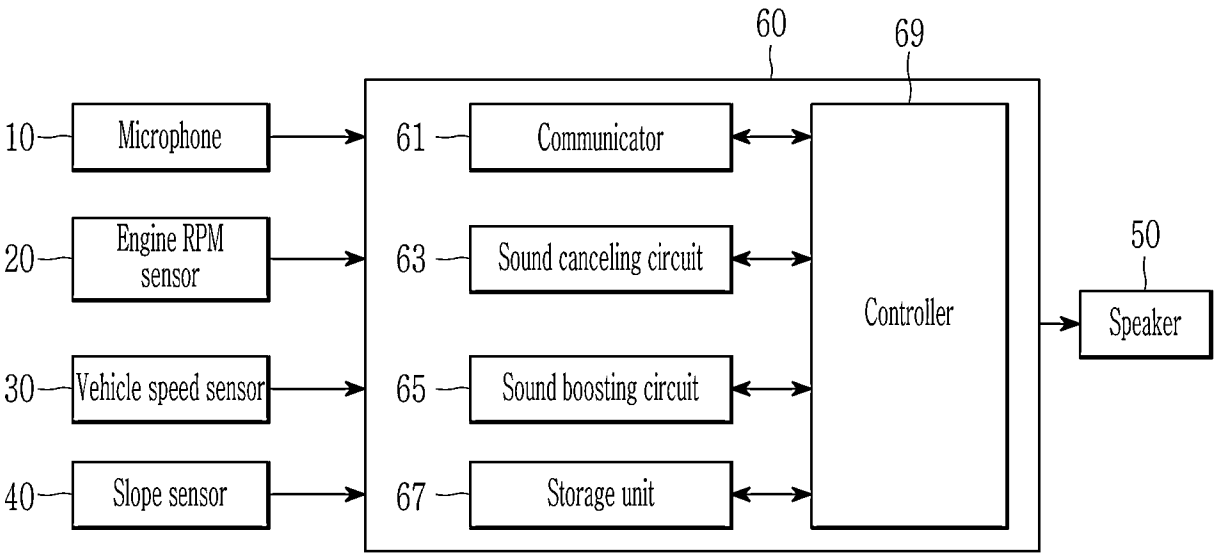
FIG. 2 shows a block diagram of a sound control device shown in FIG. 1.
Figure 3:
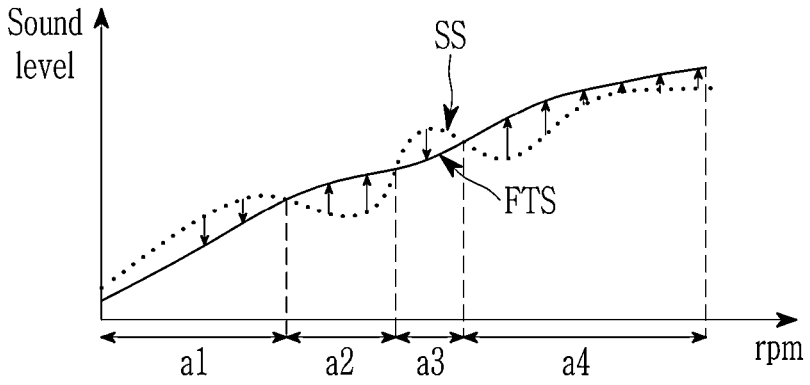
FIG. 3 shows a method for controlling an interior sound of a vehicle when the vehicle travels on a flatland according to an embodiment.

FIG. 1 shows a vehicle system for controlling an interior sound of a vehicle according to an embodiment, FIG. 2 shows a block diagram of a sound control device shown in FIG. 1, FIG. 3 shows a method for controlling an interior sound of a vehicle when the vehicle travels on a flatland according to an embodiment, and FIG. 4 to FIG. 7 show a method for controlling an interior sound of a vehicle when the vehicle travels on a ramp according to another embodiment.

Referring to FIG. 1, the vehicle system 1 includes a microphone 10, an engine RPM sensor 20, a vehicle speed sensor 30, a slope sensor 40, a speaker 50, and a sound control device 60.

The microphone 10 measures an interior sound of a vehicle, converts the measured interior sound into a corresponding electrical signal, and transmits the electrical signal to the sound control device 60. The interior sound of the vehicle may include an engine sound generated when the engine operates, and a road surface sound generated by friction between wheels of the vehicle and the road surface.

The engine RPM sensor 20 senses the revolutions per minute (RPM) when the vehicle travels, and transmits the measured engine RPM to the sound control device 60. For example, the engine RPM sensor 20 may be realized with a sensor for sensing the engine RPM. The engine RPM may be a number of revolutions by a crankshaft per minute.

The vehicle speed sensor 30 measures a speed of the vehicle when the vehicle travels, and transmits the measured vehicle speed value to the sound control device 60. For example, the vehicle speed sensor 30 may be realized with a vehicle speed sensor.

The slope sensor 40 measures a slope of the road on which the vehicle travels, and transmits the measured slope value of the road to the sound control device 60. For example, the slope sensor 40 may be realized with a slope detecting sensor for measuring the slope of the road, but is not limited thereto.

For example, when the vehicle system 1 has no slope detecting sensor, the engine RPM sensor 20 may calculate the slope of the road based on a driving torque, or may calculate a difference value between an acceleration value measured by an acceleration sensor (not shown) and a derivative value of the vehicle speed and may calculate the slope value of the road based on the difference value and a gravitational acceleration value.

The speaker 50 may output a correcting sound generated by the sound control device 60 to the inside of the vehicle. The correcting sound generated by the sound control device 60 overlaps the interior sound generated as the vehicle travels, so the driver of the vehicle hears a target sound. The target sound may be a sound that a passenger may not perceive as noise. In some embodiments, the target sound may be differently set according to the vehicle speed, the engine RPM, and the slope of the road.

The sound control device 60 may generate a correcting sound so that the interior sound may follow the target sound. In some embodiments, the sound control device 60 may set a level of a second target sound corresponding to the ramp to be less than a level of a first target sound corresponding to the flatland. The flatland may be a road of which an absolute value of the slope traveled by the vehicle is equal to or less than a reference value. The ramp may be a road of which the absolute value of the slope traveled by the vehicle is greater than a reference value. The ramp may be an uphill road or a downhill road.

Referring to FIG. 2, the sound control device 60 includes a communicator 61, a sound canceling circuit 63, a sound boosting circuit 65, a storage unit 67, and a controller 69.

The communicator 61 may include a communication module for communicating with the microphone 10, the engine RPM sensor 20, the vehicle speed sensor 30, the slope sensor 40, and the speaker 50. For example, the communicator 61 may include a CAN communication module, and may receive the interior sound from the microphone 10, the engine RPM from the engine RPM sensor 20, the vehicle speed value from the vehicle speed sensor 30, and the slope value of the road from the slope sensor 40. For another example, the communicator 61 may include a CAN communication module and may transmit the correcting sound to the speaker 50.

The sound canceling circuit 63 generates a first correcting sound for reducing the interior sound by control of the controller 69. In detail, when the first correcting sound overlaps the interior sound, destructive interference by which an amplitude (level) of the interior sound is reduced may be generated. For example, the sound canceling circuit 63 may be an active noise control (ANC) circuit.

A phase of the first correcting sound may be opposite to a phase of the interior sound (e.g., retardation of 180°). The level of the first correcting sound may correspond to a difference value between the level of the interior sound and the level of the target sound. A detailed description is provided with reference to FIG. 3 and FIG. 7.

The sound boosting circuit 65 generates a second correcting sound for boosting the interior sound by control of the controller 69. In detail, when the second correcting sound overlaps the interior sound, constructive interference by which the amplitude (level) of the interior sound is increased may be generated. For example, the sound boosting circuit 65 may be an active sound design (ASD) circuit.

The phase of the second correcting sound may correspond to the phase of the interior sound (e.g., retardation of 0° or retardation of 360°). The level of the second correcting sound may correspond to the difference value between the level of the interior sound and the level of the target sound. A detailed description is provided with reference to FIG. 3 and FIG. 7.

The storage unit 67 may store levels of a plurality of first target sounds corresponding to a predetermined engine RPM, a plurality of first correction values corresponding to a predetermined slope value and a predetermined engine RPM, and a plurality of second correction values corresponding to a predetermined slope value and a predetermined vehicle speed value. The storage unit 67 may also store interior sounds, engine RPMs, vehicle speed values, and road slope values received by the communicator 61 in real time or for a predetermined period.

The controller 69 may specify the level of the target sound. The controller 69 may control the sound canceling circuit 63 and the sound boosting circuit 65 so as to generate the correcting sound so that the interior sound may follow the level of the target sound.

According to an embodiment, when the vehicle travels on the flatland, the controller 69 extracts the level of a first target sound corresponding to the engine RPM from the storage unit 67. The controller 69 may control the sound canceling circuit 63 and the sound boosting circuit 65 so as to generate the correcting sound so that the level of the interior sound may follow the level of the first target sound.

Referring to FIG. 3, when the engine RPM changes into a first section (a1) or a third section (a3), the level of the interior sound (SS) is higher than the level of the first target sound (FTS) in the first section (a1) or the third section (a3). To lower the level of the interior sound (SS) to the level of the first target sound (FTS), the controller 69 may generate the first correcting sound by controlling the sound canceling circuit 63. The sound canceling circuit 63 may determine the level of the first correcting sound so that the level of the interior sound (SS) may follow the level of the first target sound (FTS).

When the engine RPM changed into a second section (a2) or a fourth section (a4), the level of the interior sound (SS) is lower than the level of the first target sound (FTS) in the second section (a2) or the fourth section (a4). To increase the level of the interior sound (SS) to the level of the first target sound (FTS), the controller 69 may generate the second correcting sound by controlling the sound boosting circuit 65. The sound boosting circuit 65 may determine the level of the second correcting sound so that the level of the interior sound (SS) may follow the level of the first target sound (FTS).

According to another embodiment, when the vehicle travels on the ramp, the controller 69 may reflect a correction value that corresponds to the slope value of the road to the level of the first target sound that corresponds to the engine RPM, and may calculate the level of the second target sound. That is, the first target sound is a target sound when the vehicle travels on the flatland, and the second target sound is a target sound when it travels on the ramp. The second target sound may be changed corresponding to the engine RPM, the slope value of the road, and the vehicle speed value.

Figure 4:
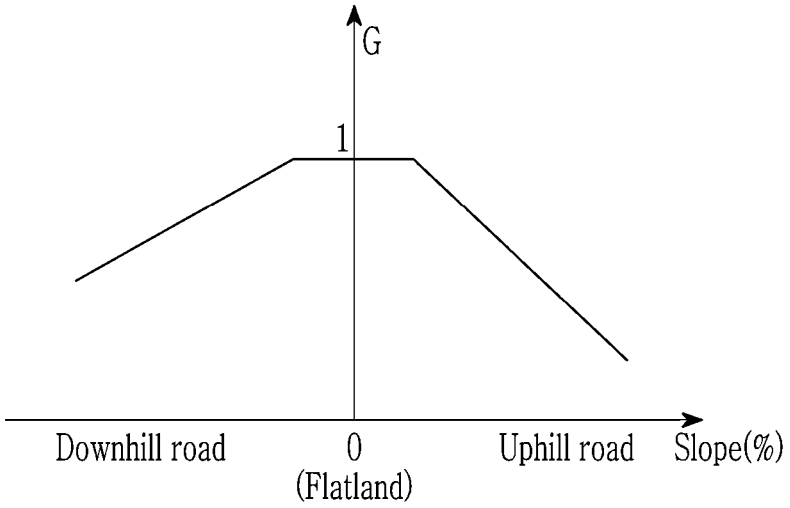
FIG. 4 to FIG. 7 show a method for controlling an interior sound of a vehicle when the vehicle travels on a ramp according to another embodiment.

FIG. 4 exemplifies changes of a first correction value (G) corresponding to a relationship between a slope of a road and an engine RPM according to another embodiment. A horizontal axis may be a slope value of the road, and a perpendicular axis may be a first correction value (G). When the absolute value of the slope of the road may be equal to or less than a predetermined reference value, it may be considered as a flatland.

A graph shown in FIG. 4 may be set for the respective engine RPMs, and the slope values of the graph may be different corresponding to the engine RPMs. For example, FIG. 4 may show changes of the first correction value (G) when the engine RPM is 2000 rpm (hereinafter, X). For another example, when the engine RPM is 3,000 rpm, the graph for describing changes of the first correction value (G) may have a greater slope value than the graph shown in FIG. 4.

Referring to FIG. 4, regarding the engine RPM, the first correction value (G) may be 1 on the flatland, and the first correction value (G) may be a positive integer that is less than 1 on the ramp. As the absolute value of the slope of the road increases, the first correction value (G) may be reduced.

Figure 5:
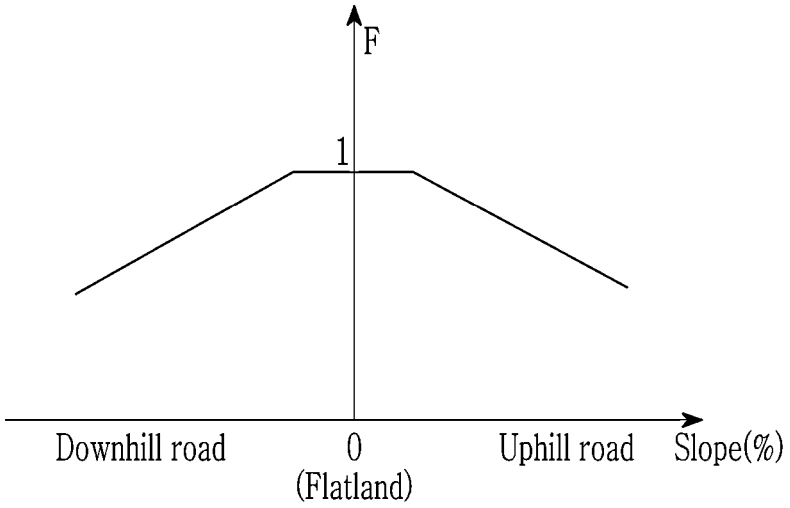

FIG. 5 exemplifies changes of a second correction value (F) corresponding to a relationship between a slope of a road and a vehicle speed according to another embodiment. The horizontal axis may be the slope value of the road, and the perpendicular axis may be the second correction value (F). When the absolute value of the slope of the road may be equal to or less than a predetermined reference value, it may be considered as a flatland.

A graph shown in FIG. 5 may be set for the respective vehicle speeds, and the slope values of the graph may be different corresponding to the vehicle speeds. For example, FIG. 5 may show changes of the second correction value (F)

when the vehicle speed is 30 Km/h (hereinafter, Y). For another example, when the vehicle speed is 60 Km/h, the graph for changes of the second correction value (F) may have a greater slope than the graph shown in FIG. 5.

Referring to FIG. 5, regarding the vehicle speed, the second correction value (F) may be 1 on the flatland, and the second correction value (F) may be a positive integer that is less than 1 on the ramp As the absolute value of the slope of the road increases, the second correction value (F) may be reduced.

Figure 6:
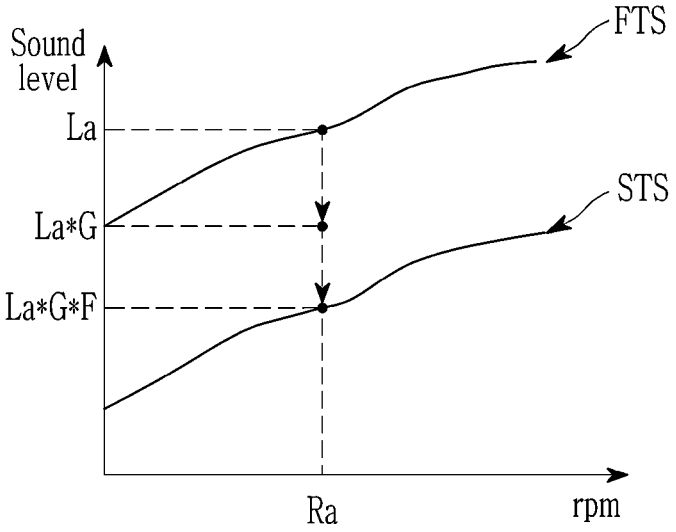

FIG. 6 exemplifies a method for calculating a level of a second target sound (STS) for controlling an interior sound of a vehicle when the vehicle travels on a ramp according to another embodiment.

Referring to FIG. 6, the controller 69 extracts a level (La) of the first target sound (FTS) corresponding to the engine RPM measured at a predetermined time, a first correction value (G) corresponding to the slope value of the road and the engine RPM, and a second correction value (F) corresponding to the slope value of the road and the vehicle speed value from the storage unit 67. The controller 69 may calculate a level (La*G*F) of the second target sound (STS) by multiplying the level (La) of the first target sound (FTS) by the first correction value (G) and the second correction value (F). For example, assuming that the first correction value (G) is 0.5 and the second correction value (F) is 0.7, the controller 69 may calculate the level (La*0.5*0.7=0.35La) of the second target sound (STS) by multiplying the level (La) of the first target sound (FTS) by 0.5 and 0.7.

The controller 69 may control the sound canceling circuit 63 and the sound boosting circuit 65 so as to generate the correcting sound so that the level of the interior sound may follow the level of the second target sound (STS).

Figure 7:
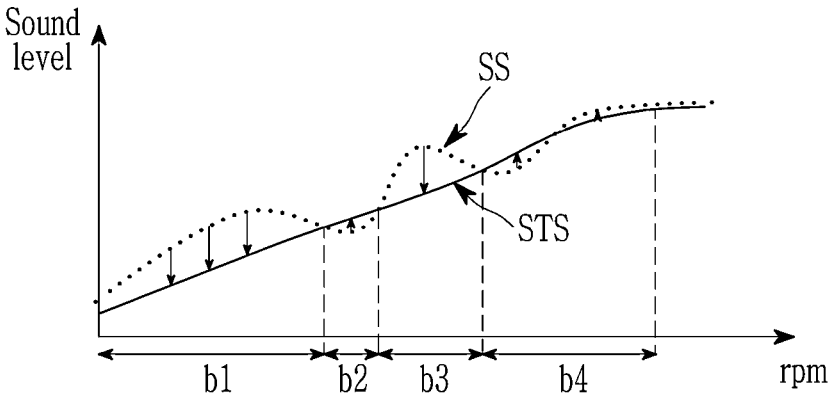

FIG. 7 shows a method for controlling an interior sound of a vehicle when the vehicle travels on a ramp according to another embodiment. Referring to FIG. 7, when the engine RPM changes into a first section (b1) or a third section (b3), the level of the interior sound (SS) is higher than the level of the second target sound (STS) in the first section (b1) or the third section (b3). To lower the level of the interior sound (SS) to the level of the second target sound (STS), the controller 69 may generate the first correcting sound by controlling the sound canceling circuit 63. In this instance, the sound canceling circuit 63 may determine the level of the first correcting sound so that the level of the interior sound (SS) may follow the level of the second target sound (STS).

When the engine RPM changes into a second section (b2) or a fourth section (b4), the level of the interior sound (SS) is lower than the level of the second target sound (STS) in the second section (b2) or the fourth section (b4). To increase the level of the interior sound (SS) to the level of the second target sound (STS), the controller 69 may generate the second correcting sound by controlling the sound boosting circuit 65. Here, the sound boosting circuit 65 may determine the level of the second correcting sound so that the level of the interior sound (SS) may follow the level of the second target sound (STS).

Figure 8:
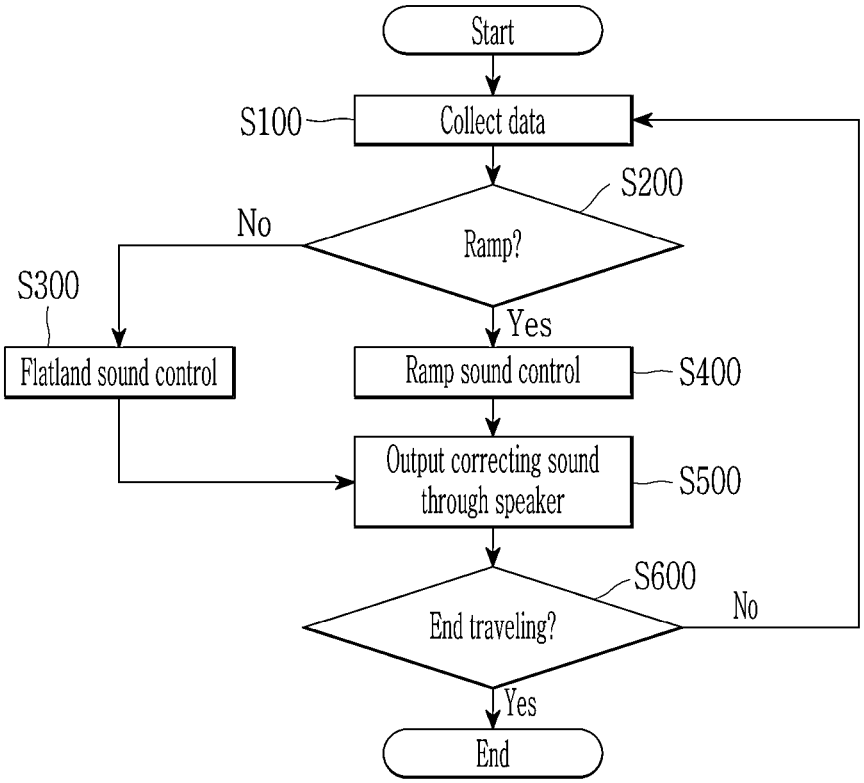
FIG. 8 shows a flowchart of a method for controlling an interior sound of a vehicle according to an embodiment.
Figure 9:
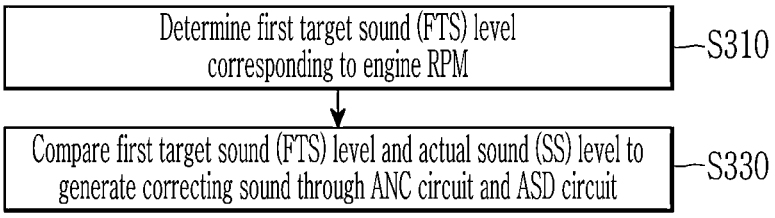
FIG. 9 shows a flowchart for a flatland sound control (S300) of FIG. 8.
Figure 10:
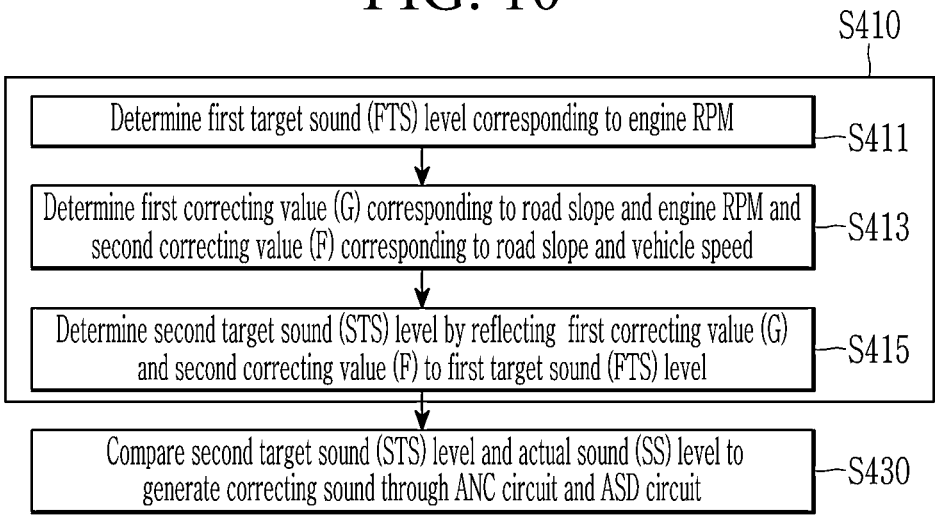
FIG. 10 shows a flowchart for a ramp sound control (S400) of FIG. 8.

FIG. 8 shows a flowchart of a method for controlling an interior sound of a vehicle according to an embodiment, FIG. 9 shows a flowchart for a flatland sound control (S300) of FIG. 8, and FIG. 10 shows a flowchart for a ramp sound control (S400) of FIG. 8.

A method for controlling an interior sound of a vehicle, and a device for controlling sound providing the method, are now described with reference to FIG. 1 to FIG. 10.

Referring to FIG. 8, the engine RPM is received from the sensor 20, the vehicle speed value is received from the vehicle speed sensor 30, and the slope value of the road is received from the slope sensor 40 through the controller 69 and the communicator 61 for predetermined periods (S100).

The controller 69 determines whether the road on which the vehicle is currently traveling is a flatland or a ramp based on the slope value of the road (S200).

According to an embodiment, the controller 69 may determine it to be a flatland when the absolute value of the slope is equal to or less than a reference value. The controller 69 may determine it to be a ramp when the absolute value of the slope is greater than a reference value. The controller 69 may determine it to be an uphill road when the slope value is greater than a reference value. The controller 69 may determine it to be downhill road when the absolute value of the slope is greater than a reference value and the slope is a negative number.

According to another embodiment, the controller 69 may receive geographical information from a navigation device (not shown) and a steering angle signal from a steering sensor (not shown) through the communicator 61 for respective predetermined periods (S100). The controller 69 may determine a winding road or mountainous terrain based on at least one of the geographical information and the steering angle signal (S200). For example, the controller 69 may determine it to be a winding road when a lateral acceleration is equal to or greater than a predetermined reference value within a predetermined time, and a steering angle is equal to or greater than a predetermined reference value. The vehicle may be anticipated to be frequently accelerated or decelerated on the winding road or the mountainous terrain, so when the road is determined to be a winding road or a mountainous terrain, the controller 69 may perform a stage of S400 (a ramp sound control).

When the road is found to be a flatland according to a result of determination (S200, No), the controller 69 performs flatland sound control (S300).

Referring to FIG. 9, in S300, the controller 69 extracts the level of the first target sound (FTS) corresponding to the engine RPM from the storage unit 67 (S310).

An expression (SIL) of the level of sound intensity may be a value expressed in a logarithmic way by comparing intensity ($I_0$) of the reference sound and intensity (Ir) of an actual sound. The intensity ($I_0$) of the reference sound may be intensity of a weakest sound a user may hear at 1 KHz. In an embodiment, the intensity of the sound is expressed by levels, and without being limited thereto, various methods for expressing sound intensities may be used.

Referring to FIG. 3, the level of the first target sound (FTS) corresponding to the engine RPM is expressed with a solid line. That is, the corresponding levels of the first target sound (FTS) may be different for the respective engine RPMs. FIG. 3 may exemplify a tendency of the level of the first target sound (FTS) as the engine RPM increases. For example, a coordinate value (x, y) corresponding to the graph shown with a solid line in FIG. 3 may be stored as a lookup table in the storage unit 67. Here, x may be the engine RPM, and y may be the level of the first target sound (FTS).

In S300, the controller 69 may control the sound canceling circuit 63 and the sound boosting circuit 65 so as to generate the correcting sound so that the level of the interior sound (SS) may follow the level of the first target sound (FTS) (S330).

The controller 69 may compare the level of the interior sound (SS) and the level of the first target sound (FTS), and may calculate a corresponding difference value. For example, when the level of the interior sound (SS) is higher than the level of the first target sound (FTS), the controller 69 may generate the first correcting sound for canceling a difference value by controlling the sound canceling circuit 63. For another example, when the level of the interior sound (SS) is lower than the level of the first target sound (FTS), the controller 69 may generate the second correcting sound for boosting a difference value by controlling the sound boosting circuit 65.

When the road is found to be a ramp according to a result of determination (S200, Yes), the controller 69 controls the ramp sound (S400).

Referring to FIG. 10, in S400, the controller 69 determines the level of the second target sound (STS) so that the level of the second target sound (STS) corresponding to the ramp may be lower than the level of the first target sound (FTS) corresponding to the flatland (S410).

In S410, the controller 69 determines the level of the first target sound corresponding to the engine RPM of the vehicle (S411).

Referring to FIG. 6, the level of the first target sound (FTS) corresponding to the engine RPM is indicated with the solid line. That is, the levels of the first target sound (FTS) may be different for the respective engine RPMs. FIG. 6 may exemplify a tendency of the level of the first target sound (FTS) as the engine RPM increases. For example, the coordinate value (x, y) corresponding to the graph shown with a solid line in FIG. 6 may be stored as a lookup table in the storage unit 67. Here, x may be the engine RPM, and y may be the level of the first target sound (FTS).

In S410, the controller 69 determines the first correction value and the second correction value (S413).

The first correction value may correspond to the slope value of the road on which the vehicle travels and the engine RPM of the vehicle. The second correction value may correspond to the slope value of the road on which the vehicle travels and the vehicle speed value of the vehicle.

Referring to FIG. 4, the first correction value (G) is 1 on the flatland. As the absolute value of the slope increases, the first correction value (G) is reduced on the ramp. For example, as the slope of the road increases, the vehicle increases the engine RPM while traveling so as to obtain the driving torque on the uphill road. The engine sound of the vehicle also gradually increases. Because of the increased engine RPM, vibration of the vehicle body increases and booming noise also increases. When the vehicle travels on the uphill road, compared to the traveling on the flatland, at the same vehicle speed, the level of the sound the driver hears may increase, and the driver may recognize the sound as noise. Hence, on the uphill road, as the slope value becomes greater, the level of the target sound is needed to be lowered, and this may be reflected through the first correction value (G).

Referring to FIG. 5, the second correction value (F) is 1 on the flatland. As the absolute value of the slope increases, the second correction value (F) has the tendency of being reduced on the ramp. That is, as the slope of the road increases, the vehicle speed increases on the downhill road, and a road surface sound caused by friction with the road surface may also increase. An engine brake may also be used to prevent sliding and maintain the speed on the downhill road, and the engine RPM may increase in this instance. The engine sound of the vehicle also gradually increases. When the vehicle travels on the downhill road, compared to the traveling on the flatland, at the same vehicle speed, the level of the sound the driver hears may increase, and the driver may recognize the sound as noise. Hence, on the downhill road, as the slope value becomes greater, the level of the target sound is needed to be lowered, and this may be reflected through the second correction value (G).

In S410, the controller 69 determines the level of the second target sound based on the level of the first target sound, the first correction value, and the second correction value (S415). The first correction value and the second correction value may be positive integers that are respectively less than the natural number of 1.

Referring to FIG. 6, the controller 69 may calculate the level (La*G*F) of the second target sound (STS) by multiplying the level (La) of the first target sound (FTS) by the first correction value (G) and the second correction value (F). For example, assuming that the first correction value (G) is 0.5 and the second correction value (F) is 0.7, the controller 69 may calculate the level (La*0.5*0.7=0.35La) of the second target sound (STS) by multiplying the level (La) of the first target sound (FTS) by 0.5 and 0.7.

Referring to FIG. 6 and FIG. 7, the level of the second target sound (STS) corresponding to the engine RPM is expressed with a solid line. That is, the corresponding levels of the second target sound (STS) may be different for the respective engine RPMs. FIG. 6 and FIG. 7 may exemplify a tendency of the level of the second target sound (STS) as the engine RPM increases. For example, the coordinate value (x, y) corresponding to the graph shown in FIG. 6 and FIG. 7 may be stored as a lookup table in the storage unit 67. Here, x may be the engine RPM, and y may be the level of the second target sound (STS).

In S400, the controller 69 may generate the first correcting sound for lowering the level of the interior sound (SS) or the second correcting sound for increasing the level of the interior sound (SS) so that the level of the interior sound (SS) may follow the level of the second target sound (STS) (S430).

The controller 69 may generate the first correcting sound by controlling the sound canceling circuit 63. The controller 69 may generate the second correcting sound by controlling the sound boosting circuit 65.

For example, the controller 69 may compare the level of the interior sound (SS) and the level of the second target sound (STS), and may calculate the corresponding difference value. For example, when the level of the interior sound (SS) is higher than the level of the second target sound (STS), the controller 69 may generate the first correcting sound for canceling the difference value by controlling the sound canceling circuit 63. For another example, when the level of the interior sound (SS) is lower than the level of the second target sound (STS), the controller 69 may generate the second correcting sound for boosting the difference value by controlling the sound boosting circuit 65.

The controller 69 outputs the first correcting sound or the second correcting sound through the speaker 50 (S500).

When the vehicle does not end traveling (S600, No), the controller 69 controls the interior sound of the vehicle by repeating from S100. When the vehicle ends traveling (S600, Yes), the controller 69 ends the interior sound control of the vehicle.

While this present disclosure has been described in connection with what is presently considered to be practical embodiments, it is to be understood that the present disclosure is not limited to the disclosed embodiments, but, on the contrary, is intended to cover various modifications and equivalent arrangements included within the spirit and scope of the appended claims.

What is claimed is:

1. A device for controlling an interior sound in a vehicle, the device comprising:

a sound canceling circuit configured to generate a first correcting sound for lowering a level of an interior sound measured in the vehicle;

a sound boosting circuit configured to generate a second correcting sound for increasing the level of the interior sound; and a controller configured to determine a level of a first target sound and a level of a second target sound, wherein:

the level of the second target sound corresponds to a ramp in which an absolute value of a slope of a road on which the vehicle travels is greater than a reference value, and the level of the first target sound corresponds to a flatland in which the absolute value of the slope is equal to or less than the reference value, the level of the second target sound is lower than the level of the first target sound, and when the vehicle travels on the ramp, the controller is further configured to control the sound canceling circuit and the sound boosting circuit so that the level of the interior sound follows the level of the second target sound.

2. The device of claim 1, wherein:

the controller is further configured to determine the level of the first target sound corresponding to revolutions per minute (RPM) of an engine of the vehicle, a first correction value corresponding to a slope value of the road and the engine RPM of the vehicle, and a second correction value corresponding to the slope value of the road and a speed value of the vehicle, and the controller is further configured to determine the level of the second target sound based on the level of the first target sound, the first correction value, and the second correction value.

3. The device of claim 1, further comprising:

a storage unit configured to store levels of a plurality of first target sounds corresponding to revolutions per minute (RPM) of an engine of the vehicle, a plurality of first correction values corresponding to the slope value of the road and the engine RPM, and a plurality of second correction values corresponding to the slope value of the road and a speed value of the vehicle.

4. The device of claim 2, wherein the first correction value and the second correction value are respectively positive integers that are less than a natural number of 1.

5. The device of claim 4, wherein the controller is further configured to control a communicator for a speaker to output the first correcting sound or the second correcting sound in the vehicle.

6. The device of claim 2, wherein the controller is further configured to generate the first correcting sound by controlling the sound canceling circuit when the level of the interior sound is higher than the level of the second target sound.

7. The device of claim 6, wherein the controller is further configured to generate the second correcting sound by controlling the sound boosting circuit when the level of the interior sound is lower than the level of the second target sound.

8. The device of claim 7, wherein the sound canceling circuit is an active noise control (ANC) circuit.

9. The device of claim 8, wherein the sound boosting circuit is an active sound design (ASD) circuit.

10. A method for controlling an interior sound in a vehicle, the method comprising:

determining whether a road on which a vehicle travels is a flatland in which an absolute value of a slope of the road is equal to or less than a reference value or a ramp in which the absolute value of the slope is greater than the reference value;

determining a level of a first target sound corresponding to the flatland and a level of a second target sound corresponding to the ramp, wherein the level of the second target sound is lower than the level of the first target sound when the road is the ramp; and generating a first correcting sound for lowering the level of the interior sound or a second correcting sound for increasing the level of the interior sound so that the level of the interior sound follows the level of the second target sound.

11. The method of claim 10, wherein the determining of a level of second target sound includes:

determining the level of the first target sound corresponding to revolutions per minute (RPM) of an engine of the vehicle;

determining a first correction value corresponding to a slope value of the road and the engine RPM, and a second correction value corresponding to the slope value of the road and a vehicle speed value of the vehicle; and determining the level of the second target sound based on the level of the first target sound, the first correction value, and the second correction value.

12. The method of claim 11, wherein the first correction value and the second correction value are respectively positive integers that are less than a natural number of 1.

13. The method of claim 12, wherein the generating of the first correcting sound or the second correcting sound includes generating the first correcting sound when the level of the interior sound is higher than the level of the second target sound.

14. The method of claim 13, wherein the generating of the first correcting sound or the second correcting sound includes generating the second correcting sound when the level of the interior sound is lower than the level of the second target sound.

15. The method of claim 14, further comprising outputting the first correcting sound or the second correcting sound in the vehicle through a speaker.

* * * * *